US010483630B2

(12) United States Patent
Biedscheid et al.

(10) Patent No.: US 10,483,630 B2
(45) Date of Patent: Nov. 19, 2019

(54) WING LEADING EDGE ANTENNA SYSTEM

(71) Applicant: The Boeing Company, Chicago, IL (US)

(72) Inventors: Rick A Biedscheid, Mukilteo, WA (US); Devin W Hill, Lake Stevens, WA (US)

(73) Assignee: The Boeing Company, Chicago, IL (US)

( * ) Notice: Subject to any disclaimer, the term of this patent is extended or adjusted under 35 U.S.C. 154(b) by 163 days.

(21) Appl. No.: 15/811,596

(22) Filed: Nov. 13, 2017

(65) Prior Publication Data

US 2019/0148820 A1 May 16, 2019

(51) Int. Cl.

| | |
|---|---|
| ***H01Q 1/28*** | (2006.01) |
| ***H01Q 19/30*** | (2006.01) |
| ***H01Q 13/10*** | (2006.01) |
| ***H01Q 21/10*** | (2006.01) |
| ***H01Q 21/06*** | (2006.01) |
| ***H01Q 3/34*** | (2006.01) |
| ***H01Q 9/04*** | (2006.01) |
| ***H01Q 21/00*** | (2006.01) |

(52) U.S. Cl.

CPC ..... *H01Q 1/287* (2013.01); *H01Q 3/34* (2013.01); *H01Q 9/045* (2013.01); *H01Q 13/103* (2013.01); *H01Q 19/30* (2013.01); *H01Q 21/0031* (2013.01); *H01Q 21/064* (2013.01); *H01Q 21/065* (2013.01); *H01Q 21/10* (2013.01)

(58) Field of Classification Search

CPC ..... H01Q 1/287; H01Q 3/34; H01Q 9/045; H01Q 19/30; H01Q 13/103

USPC ..... 343/708

See application file for complete search history.

(56) References Cited

U.S. PATENT DOCUMENTS

| | | | | |
|---|---|---|---|---|
| 4,346,386 A * | 8/1982 | Francis | H01Q 3/06 | 343/705 |
| 4,749,997 A * | 6/1988 | Canonico | H01Q 1/287 | 343/705 |
| 4,912,477 A * | 3/1990 | Lory | H01Q 1/287 | 342/372 |
| 10,290,931 B1 * | 5/2019 | Judd | H01Q 1/287 | |
| 2010/0213042 A1 * | 8/2010 | Smidt | A47C 31/008 | 200/5 A |

* cited by examiner

*Primary Examiner* — Huedung X Mancuso

(74) *Attorney, Agent, or Firm* — Toler Law Group, PC

(57) ABSTRACT

Disclosed is a wing leading edge antenna system ("WLEAS"). The WLEAS includes an upper leading edge ("LE") of a wing of an aircraft, a two-dimensional non-gimbaled scannable antenna ("2D-NGSA"), and an adapter plate. The upper LE of the wing includes two LE ribs and a LE cavity formed by the two LE ribs and a lower LE surface of the wing and the adapter plate is attached to both of the LE ribs within the LE cavity. Moreover, the 2D-NGSA is attached to the adapter plate within the LE cavity.

20 Claims, 15 Drawing Sheets

WING LEADING EDGE ANTENNA SYSTEM

BACKGROUND

1. Field

This present invention relates generally to scannable antennas, and more particularly, to scannable antennas on the wings of aircraft.

2. Related Art

As airlines continue to offer more on-board entertainment on flights, the on-board entertainment now includes in-flight satellite television, pay-per-view movies and events, and broadband Internet communications. Current approaches to providing this type of on-board entertainment include placing large mechanically steered (i.e., gimbaled) antennas on the top of aircraft fuselages with a bulky radome that protrudes significantly from the surface of the fuselage. These large gimbaled antennas typically operate in the Ka and/or Ku radio frequency ("RF") band and are bulky and heavy. Their bulk typically adds hundreds of pounds of drag to the aircraft. As an example, in some of the larger body commercial aircraft, the drag may be approximately 840 lbs. of equivalent operating empty weight ("EOEW"). In addition, the mass weight of these types of gimbaled antennas may be approximately 200 to 300 lbs. or more based on the corresponding weight of the antenna, tri-band radome, support structure, and gimbal.

As a result, these approaches add weight and drag that reduce the fuel efficiency of the aircraft. Therefore, there is a need for a system that addresses these problems.

SUMMARY

Disclosed is a wing leading edge antenna system ("WLEAS"). The WLEAS includes an upper leading edge ("LE") of a wing of an aircraft, a two-dimensional non-gimbaled scannable antenna ("2D-NGSA"), and an adapter plate. The upper LE of the wing includes two LE ribs and a LE cavity formed by the two LE ribs and a lower LE surface of the wing and the adapter plate is attached to both of the LE ribs within the LE cavity. Moreover, the 2D-NGSA is attached to the adapter plate within the LE cavity.

Also disclosed is a scannable antenna system for use in the upper LE of a wing of an aircraft having two the LE ribs and the LE cavity formed by the two LE ribs and the lower LE of the wing. The antenna system includes the 2D-NGSA and the adapter plate attached to both of the LE ribs within the LE cavity, where the 2D-NGSA is attached to the adapter plate within the LE cavity. In general, the scannable antenna system is part of the WLEAS.

Other devices, apparatus, systems, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

A wing leading edge antenna system ("WLEAS") is disclosed. The WLEAS includes an upper leading edge ("LE") of a wing of an aircraft, a two-dimensional non-gimbaled scannable antenna ("2D-NGSA"), and an adapter plate. The upper LE of the wing includes two LE ribs and a LE cavity formed by the two LE ribs and a lower LE surface of the wing and the adapter plate is attached to both of the LE ribs within the LE cavity. Moreover, the 2D-NGSA is attached to the adapter plate within the LE cavity.

Also disclosed is a scannable antenna system for use in the upper LE of a wing of an aircraft having two the LE ribs and the LE cavity formed by the two LE ribs and the lower LE of the wing. The antenna system includes the 2D-NGSA and the adapter plate attached to both of the LE ribs within the LE cavity, where the 2D-NGSA is attached to the adapter plate within the LE cavity. In general, the scannable antenna system is part of the WLEAS.

Figure 1:
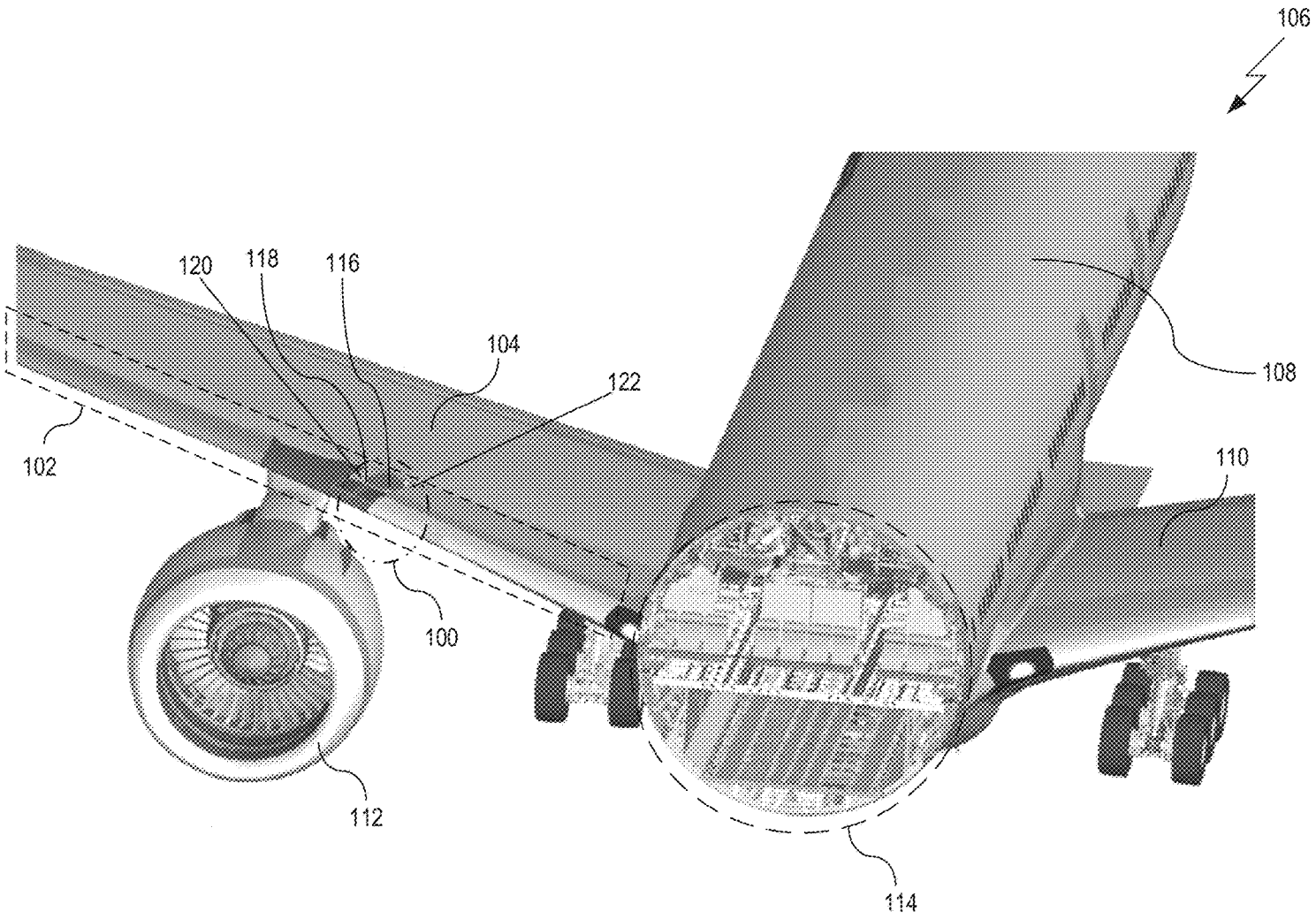
FIG. 1 is a perspective-view of a system diagram of an example of an implementation of a wing leading edge antenna system ("WLEAS") within the upper leading edge ("LE") of a wing of an aircraft in accordance with the present disclosure.

Turning to FIG. 1, a perspective-view of a system diagram is shown of an example of an implementation of WLEAS 100 within the upper LE 102 of a wing 104 of an aircraft 106 in accordance with the present disclosure. In this example, the aircraft 106 also has a fuselage 108, another wing 110, and multiple engines (of which a first engine 112 is shown for the convenience of illustration). Furthermore, in this example, the WLEAS 100 is shown located in proximity to the first engine 112 and exposed without a radome surface covering the WLEAS 100. As an example, the aircraft 106 is shown as a wide-body commercial aircraft as seen by the cut-away 114 of the front of the fuselage 108, however, it is appreciated by those of ordinary skill in the art that the aircraft 106 may alternatively be a non-wide-body aircraft.

In this example, the WLEAS 100 is a scannable antenna system that includes a 2D-NGSA 116 located within the upper LE 102 within an LE cavity 118 having a first LE rib 120 and a second LE rib 122. The WLEAS 100 also includes an adapter plate (not shown) attached to both of the LE ribs 120 and 122 and within the LE cavity 118. The 2D-NGSA 116 is attached to the adapter plate within the LE cavity 118.

Figure 2:
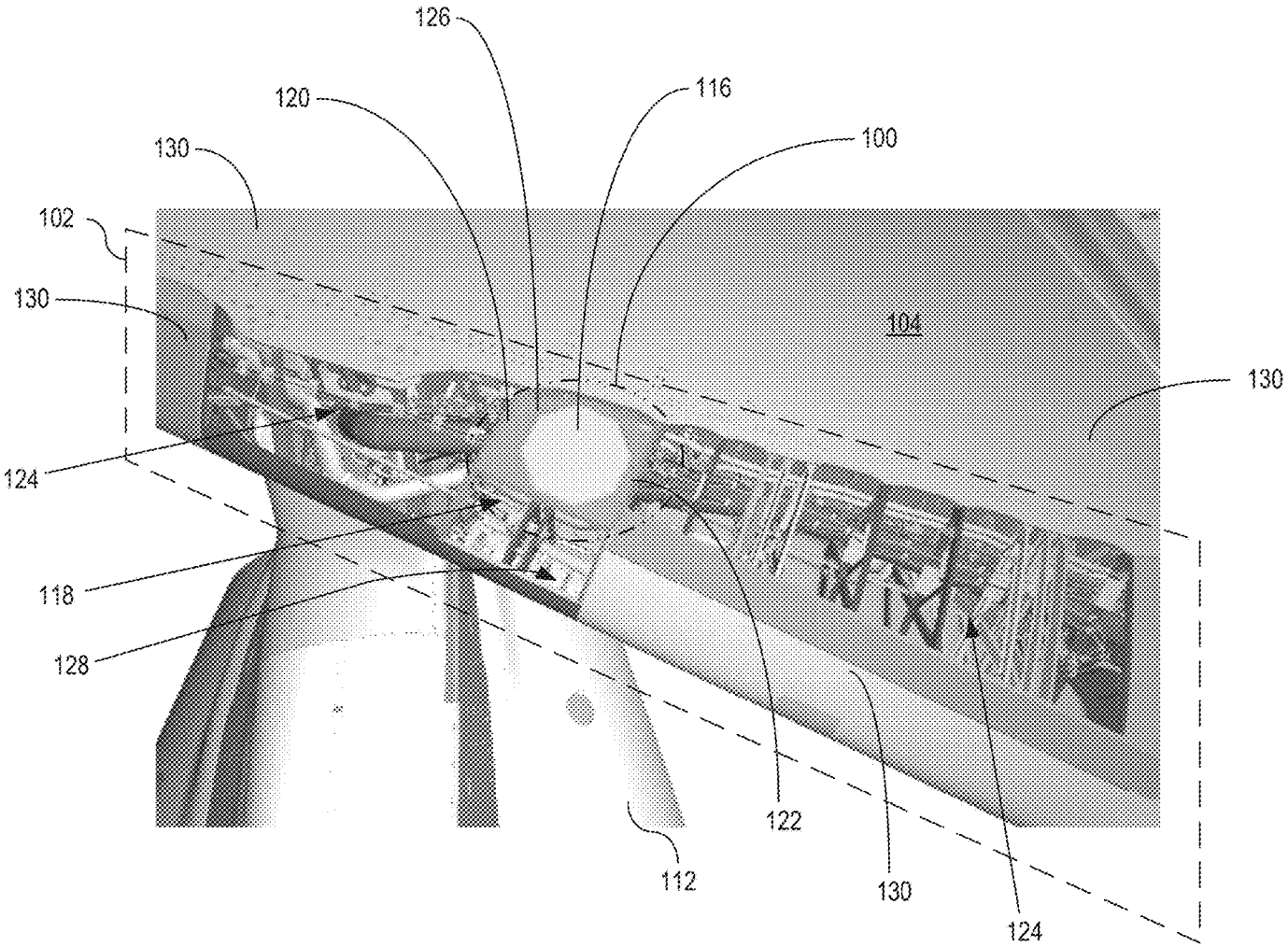
FIG. 2 is a perspective-view of a system diagram of an example of the implementation of the WLEAS on the upper LE of the wing shown in FIG. 1 in accordance with the present disclosure.

Turning to FIG. 2, a perspective-view of a system diagram is shown of an example of the implementation of the WLEAS 100 on the upper LE 102 of the wing 104 in accordance with the present disclosure. In this example, a cut-away view 124 is shown of the upper LE 102 showing the first LE rib 120, second LE rib 122, LE cavity 118, adapter plate 126, and 2D-NGSA 116. The LE cavity 118 is shown as formed by the first LE rib 120, second rib 122, and a lower LE surface 128 of the wing 104. The top of the LE cavity 118 is covered by a radome surface (not shown) so as to cover the WLEAS 100 and be flush with a wing surface 130 while allowing the 2D-NGSA 116 to transmit and receive radio frequency ("RF") signals through the radome surface. In this example, the adapter plate 126 is attached to both the first LE rib 120 and second LE rib 122 and is within the LE cavity 118. Additionally, the 2D-NGSA 116 is attached to the adapter plate 126 within the LE cavity 118. Again, the radome surface is located on the upper LE 102 of the wing 104 to cover the 2D-NGSA 116. In this example, the location of the WLEAS 100 is shown near the first engine 112 such that the WLEAS 100 may utilize the first engine 112 to optionally power the WLEAS 100.

In this example, the 2D-NGSA 116 may be a phased array antenna or other type of antenna that is non-gimbaled and capable of electronically scanning an antenna beam, or beams, in two-dimensions. The size of the 2D-NGSA 116 may vary based on the size of the wing 104 on which it is installed. In the case of larger wide-bodied commercial aircraft 106, the 2D-NGSA 116 may have a diameter that may range from approximately 18 inches to over 30 inches. In general, this diameter will be determined by the available spacing between the first rib 120 and second rib 122 of the wing 104. The thickness of the 2D-NGSA 116 should be a thin as possible to allow the 2D-NGSA 116 to properly fit within the LE cavity 118.

As an alternative example, the 2D-NGSA 116 may be a holographic antenna system similar to the one described in U.S. Patent Application 2015/0236412 A1, Ser. No. 14/550,178, titled "Dynamic Polarization and Coupling Control From a Steerable Cylindrically Fed Holographic Antenna," filed Nov. 21, 2014, by Adam Bily et al., and U.S. Patent Application 2016/0233588 A1, Ser. No. 14/954,415, titled "Combined Antenna Apertures Allowing Simultaneous Multiple Antenna Functionality," filed Nov. 30, 2015, by Adam Bily et al., both of which are herein incorporated by reference in their entirety.

In general, a holographic antenna system is a non-gimbaled metamaterial antenna design architecture that feeds the antenna from a central point with an excitation (i.e., a feed wave) that spreads in a cylindrical or concentric manner outward from the feed point. The antenna works by arranging multiple cylindrically fed sub-aperture antennas (e.g., patch antennas) with the feed wave. As an implementation alternative, the antenna is fed from the perimeter inward, rather than from the center outward. Example of implantations of the holographic antenna include a holographic antenna based on doubling the density typically required to achieve holography and filling the aperture with two types of orthogonal sets of elements. As an example, one set of elements may be linearly oriented at +45 degrees relative to the feed wave, and the second set of elements may be oriented at −45 degrees relative to the feed wave. Both types are illuminated by the same feed wave, which, in one form, is a parallel plate mode launched by a coaxial pin feed.

In general, the metamaterial antenna system uses surface scattering metamaterial technology to form and steer transmit and receive beams through separate antennas. The metamaterial antenna systems may be analog systems, in contrast to antenna systems that employ digital signal processing to electrically form and steer beams (such as phased array antennas). In this example, the holographic antenna system may include three functional subsystems: (1) a wave propagating structure consisting of a cylindrical wave feed architecture; (2) an array of wave scattering metamaterial unit cells; and (3) a control structure to command formation of an adjustable radiation field (i.e., beam) from the metamaterial scattering elements using holographic principles.

In this example, a coaxial feed may be utilized to provide a cylindrical wave feed to the metamaterial antenna system where the coaxial feed includes a center conductor and an outer conductor. As an example, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In an alternative example, a cylindrically fed antenna creates an inward travelling feed wave. In such a case, the feed wave most naturally comes from a circular structure.

Figure 3:
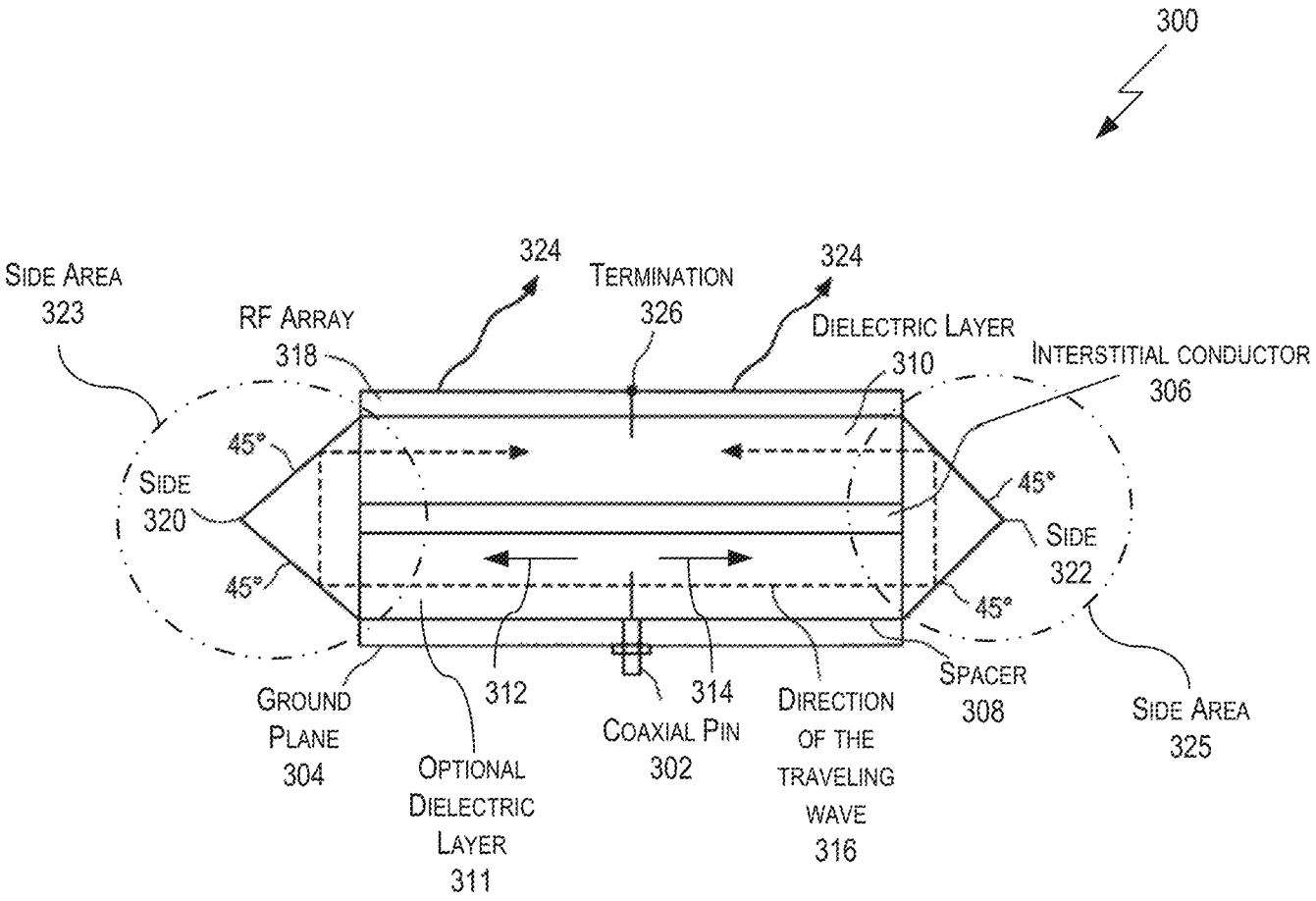
FIG. 3 is a side-view of an example of an implementation of a cylindrically fed antenna structure in accordance with the present disclosure.

Specifically, in FIG. 3 a side-view of an example of an implementation of a cylindrically fed antenna structure 300 is shown in accordance with the present disclosure. The cylindrically fed antenna structure 300 produces an inwardly travelling wave using a double layer feed structure (i.e., two layers of a feed structure). In this example, the cylindrically fed antenna structure 300 includes a circular outer shape and an antenna feed 302 that is a coaxial feed shown and referred to herein as a coaxial pin 302. The coaxial pin 302, also referred to as a coax pin, is used to excite a field on the lower level of the cylindrically fed antenna structure 300. In this example, the coaxial pin 302 may be a 50-ohm coax pin. The coaxial pin 302 is in signal communication (e.g., physically bolted and electrically coupled) with the bottom of the cylindrically fed antenna structure 300, which has a conducting ground plane 304.

Separate from conducting ground plane 304 is an interstitial conductor 306, which is an internal conductor. In this example, the conducting ground plane 304 and interstitial conductor 306 are parallel to each other. Additionally, the distance between ground plane 304 and interstitial conductor 306 may be between approximately 0.1 inch and 0.15 inch. As another example, this distance may be half of the wavelength of a travelling wave at the frequency of operation. In this example, the ground plane 304 is separated from the interstitial conductor 306 via a spacer layer 308 (also referred to generally as a spacer 308). The spacer 308 may be a foam, air-like spacer, or may include a plastic spacer.

On top, and optionally the bottom, of the interstitial conductor 306 is a dielectric layer 310 and an optional dielectric layer 311. The dielectric layer 310 may be plastic and is configured to slow a cylindrical feed travelling wave (herein referred to simply as a traveling wave) that emanates in two parts (i.e., traveling waves 312 and 314) from the coaxial pin 302 and that each travels along a direction 316 through the dielectric layer 310 relative to a free space velocity. As an example, the dielectric layer 310 may slow the travelling wave by approximately 30% relative to free space. In this example, the range of indices of refraction that are suitable for beam forming are approximately 1.2 to 1.8, where free space has by definition an index of refraction equal to 1. Other dielectric spacer materials, such as, for example, plastic, may also be used to achieve approximately the same effect. Moreover, materials other than plastic may also be used as long as they achieve the desired wave slowing effect. Alternatively, a material with distributed structures may be used as the dielectric layer 310, such as periodic sub-wavelength metallic structures that can be machined or lithographically defined, for example.

In this example, an RF-array 318 is on top of the dielectric layer 310. As an example, the distance between interstitial conductor 306 and the RF-array 318 may be approximately between 0.10 inches and 0.15 inches or more, generally about half of the effective wavelength in the medium (i.e., the dielectric layer 310) at the design frequency.

Furthermore, in this example, the cylindrically fed antenna structure 300 includes sides 320 and 322. The sides 320 and 322 are angled to cause the travelling waves 312 and 314 fed from the coax pin 302 to be propagated from the area below interstitial conductor 306 (the spacer layer 308) to the area above interstitial conductor 306 (the dielectric layer 310) via reflection. As such, the angle of sides 320 and 322 may be at 45 degree angles or at other angles that accomplish signal transmission from the lower level feed to upper level feed. In this example, the first side 320 is shown to be part of a side area 323 that includes two 45 degree angles that cause the travelling wave 312 to propagate from the spacer layer 308 to the dielectric layer 310. Similarly, the second side 322 is shown to be a side area 325 that includes two 45 degree angles that cause the travelling wave 314 to propagate from the spacer layer 308 to the dielectric layer 310.

In an example of operation, when a travelling wave 312, 314 is fed in from coaxial pin 302, the traveling wave 312, 314 travels outward (in a direction 316) concentrically oriented from coaxial pin 302 in the area between ground plane 304 and interstitial conductor 306. The concentrically outgoing traveling waves 312 and 314 are reflected by sides 320 and 322 and travel inwardly in the area between interstitial conductor 306 and RF array 318. The reflection from the edge of the circular perimeter causes the traveling wave 312 and 314 to remain in phase (i.e., it is an in-phase reflection). The travelling wave 312, 314 is slowed by the dielectric layer 310. At this point, the travelling wave 312, 314 starts interacting with and exciting the elements in the RF array 318 to obtain the desired scattering radiation 324. As will be described later, in this example the RF array 318 may include a tunable slotted array that includes a plurality of slots.

As such, in general, the WLEAS 100 may include the 2D-NGSA 116 that is a cylindrically fed antenna structure 300 that includes an antenna feed (i.e., the coaxial pin 302) and the RF array 318. The antenna feed 302 is configured to input the cylindrical feed travelling wave 312, 314. As described earlier, the antenna feed 302 is in signal communication with the RF array 318 and the RF array 318 includes a tunable slotted array having a plurality of slots, where each slot of the plurality of slots is tuned to provide a radiation pattern (i.e., the desired scattering radiation 324) from the RF array 318 at a given frequency.

Figure 4:
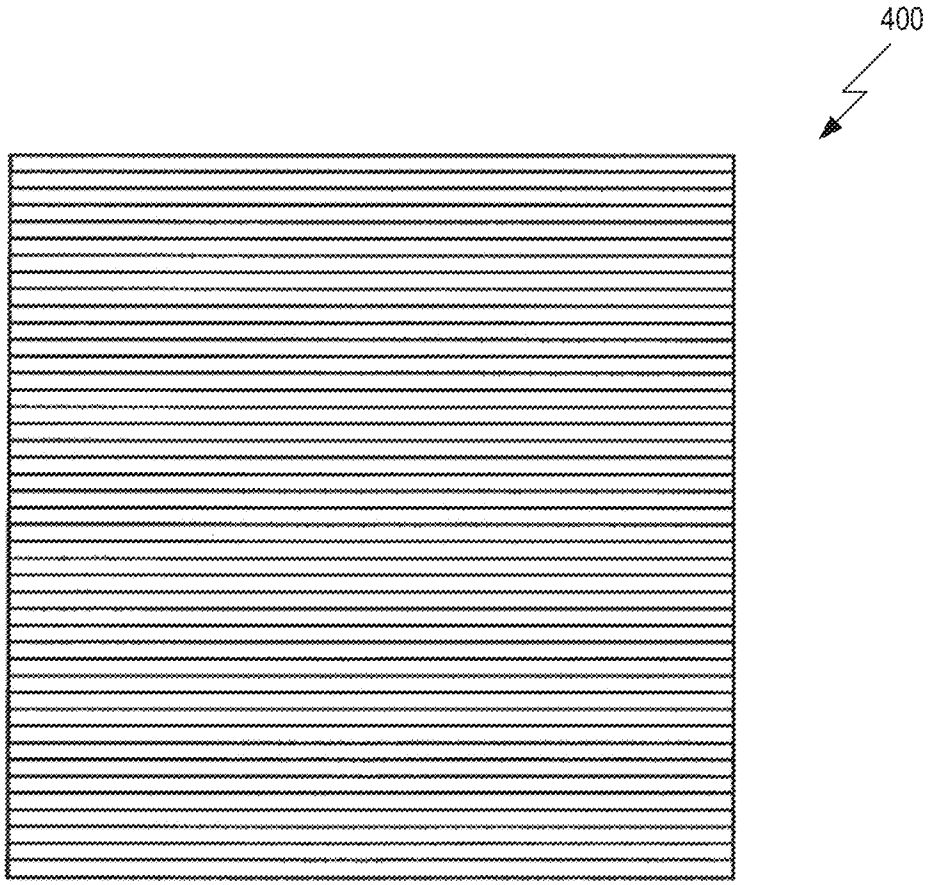
FIG. 4 is an example of an implementation of a dielectric material for use as a dielectric layer, shown in FIG. 3, in accordance with the present disclosure.

To terminate the travelling wave 312, 314, a termination 326 is included in the cylindrically fed antenna structure 300 at a geometric center of the cylindrically fed antenna structure 300. In this example, the termination 326 may include a pin termination (e.g., a 50 ohm). Alternatively, the termination 326 may include an RF absorber that terminates unused energy to prevent reflections of that unused energy back through the feed structure of the cylindrically fed antenna structure 300. Both of these approaches could be utilized at the top of RF array 318. In FIG. 4, an example of an implementation of a dielectric material 400 for use as a dielectric layer 310 (into which the fed traveling wave 312, 314) is launched is shown in accordance with the present disclosure.

Figure 5:
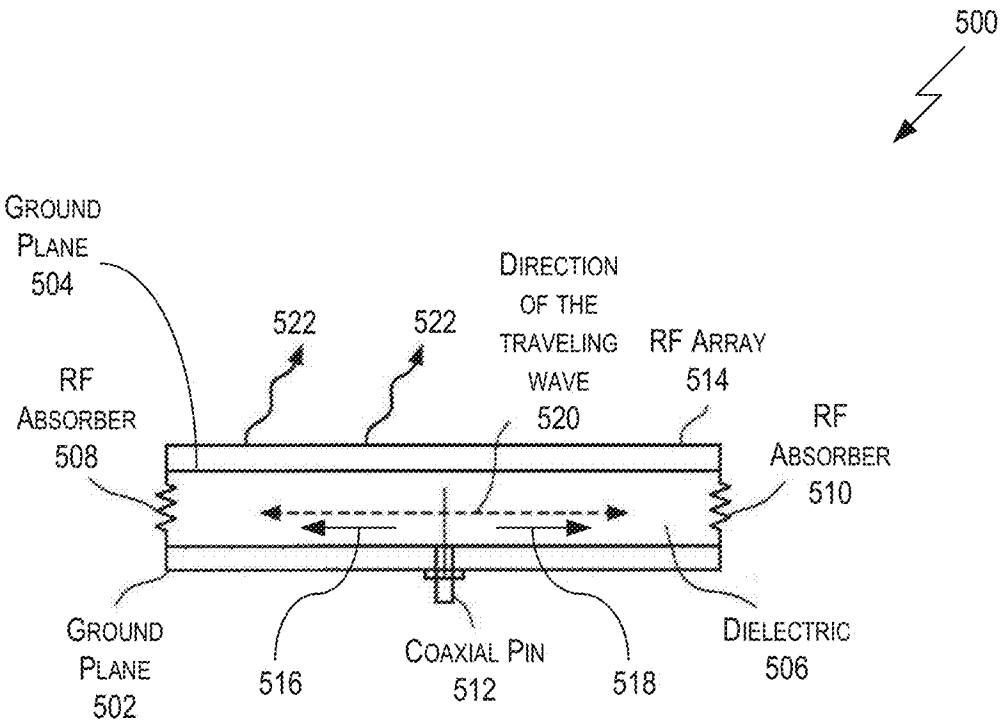
FIG. 5 is a side-view of an example of another implementation of a cylindrically fed antenna structure in accordance with the present disclosure.

Turing to FIG. 5, a side-view of an example of another implementation of a cylindrically fed antenna structure 500 is shown in accordance with the present disclosure. In this example, two ground planes 502 and 504 are substantially parallel to each other with a dielectric layer 506 (e.g., a plastic layer, etc.) in between the ground planes 502 and 504. The cylindrically fed antenna structure 500 also includes RF absorbers 508 and 510 (e.g., resistors) that are in signal communication with the two ground planes 502 and 504, grounding them together. A coaxial pin 512 (e.g., an antenna feed that is a 50 ohm coax pin) feeds the cylindrically fed antenna structure 500. An RF array 514 is also on top of dielectric layer 506.

It is also appreciated by those skilled in the art that the circuits, components, modules, and/or devices of, or associated with, the WLEAS 100 and 2D-NGSA 116 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

In operation, a cylindrical feed traveling wave 516, 518 (again herein referred to simply as a "traveling wave" that has two parts that emanate from the coaxial pin 512) is fed through the coaxial pin 512 and travels (in a direction 520) concentrically outward and interacts with the elements of RF array 514. In this example, the RF absorbers 508 and 510 may terminate the dielectric layer 506 such that unused energy is absorbed to prevent reflections of that unused energy back through the dielectric layer 506. At this point, the travelling wave 516, 518 starts interacting and exciting with elements in the RF array 514 to obtain the desired scattering radiation 522.

The cylindrical feed in both the cylindrically fed antenna structures 300 and 500 (of FIGS. 3 and 5) improves the service angle of the cylindrically fed antenna structures 300 and 500. For example, the cylindrically fed antenna structures 300 and 500 may have a service angle of approximately 75 degrees from the boresight of the cylindrically fed antenna structures 300 and 500 to all directions. It is appreciated by those of ordinary skill in the art, that the overall antenna gain of the cylindrically fed antenna structures 300 and 500 is dependent on the gain of the constituent elements, which themselves are angle-dependent.

In general, the cylindrically fed antenna structures 300 and 500 simplify the feed structure compared to known antennas fed with a corporate divider network and therefore reduce the total antenna and antenna feed volume, decrease sensitivity to manufacturing and control errors by maintaining high beam performance with coarser controls (extending all the way to simple binary control), give a more advantageous side lobe pattern compared to rectilinear feeds because the cylindrically oriented feed waves result in spatially diverse side lobes in the far field, and allow polarization to be dynamic, including allowing left-hand circular, right-hand circular, and linear polarizations, while not requiring a polarizer.

In these examples the RF array 318 and 514 (shown in FIGS. 3 and 5, respectively) include a wave scattering subsystem that includes a plurality of patch antennas (also referred to as patches, scatterers, or scattering elements) that act as electromagnetic radiators. This plurality of patches includes an array of scattering metamaterial elements. As an example, each scattering metamaterial element is part of a unit cell that includes a lower conductor, a dielectric substrate, and an upper conductor that embeds a complementary electric inductive-capacitive resonator ("complementary electric-field-coupled" or "CELC") that is etched in or deposited onto the upper conductor.

In this example, a liquid crystal ("LC") is injected in the gap around the scattering element. The LC is encapsulated in each unit cell and separates the lower conductor associated with a slot from an upper conductor associated with its patch. The LC has a permittivity that is a function of the orientation of the molecules including the LC, and the orientation of the molecules (and thus the permittivity) can be controlled by adjusting the bias voltage across the LC. Using this property, the LC acts as an on/off switch for the transmission of energy from the guided wave to the CELC. When switched on, the CELC emits an electromagnetic wave like an electrically small dipole antenna.

Controlling the thickness of the LC increases the beam switching speed. Moreover, the CELC element is responsive to a magnetic field that is applied parallel to the plane of the CELC element and perpendicular to the CELC gap complement. When a voltage is applied to the LC in the metamaterial scattering unit cell, the magnetic field component of the guided wave induces a magnetic excitation of the CELC, which, in turn, produces an electromagnetic wave in the same frequency as the guided wave. In general, the phase of the electromagnetic wave generated by a single CELC may be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

As an example, the cylindrical feed geometry of this antenna system (i.e., the cylindrically fed antenna structure) allows the CELC elements to be positioned at 45 degree angles to the vector of the wave in the wave feed. This position of the elements enables control of the polarization of the free space wave generated from or received by the elements. In this example, the CELCs may be arranged with an inter-element spacing that is less than a free-space wavelength of the operating frequency of the antenna. For example, if there are four scattering elements per wavelength, the elements in the 30 GHz transmit antenna will be approximately 2.5 mm (i.e., $1/4^{th}$ the 10 mm free-space wavelength of 30 GHz).

The CELCs may be implemented with a plurality of patches (i.e., patch antennas) that include a patch co-located over a slot with LC between the two. In this respect, the metamaterial antenna acts like a slotted (scattering) waveguide. With a slotted waveguide, the phase of the output wave depends on the location of the slot in relation to the guided wave.

Figure 6:
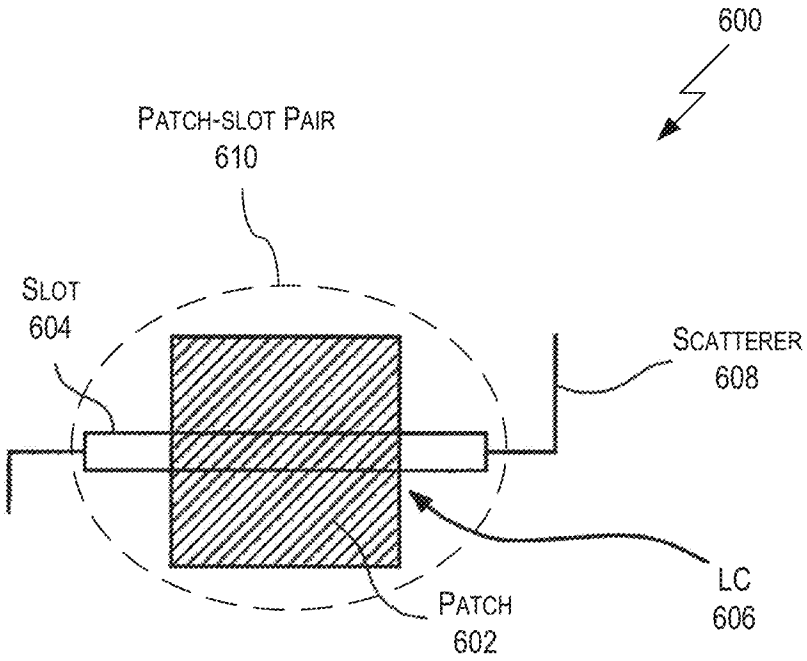
FIG. 6 is a top-view of system diagram of an example of an implementation of one patch antenna, or scattering element, in accordance with the present disclosure.

In FIG. 6, a top-view of system diagram is shown of an example of an implementation of one patch antenna 600 (also referred to as scattering element) in accordance with the present disclosure. In this example, the patch antenna 600 includes a patch 602 co-located over a slot 604 (also referred to interchangeably in this disclosure as an iris) with an LC 606 in between the patch 602 and slot 604 and a scatterer 608 in signal communication with the slot 604. In this example, the cylindrically fed antenna structure 300 or 500 would include a plurality of slots and a plurality of patches where each patch 602 is co-located over and separated from a slot 604 forming a patch-slot pair 610.

Figure 7:
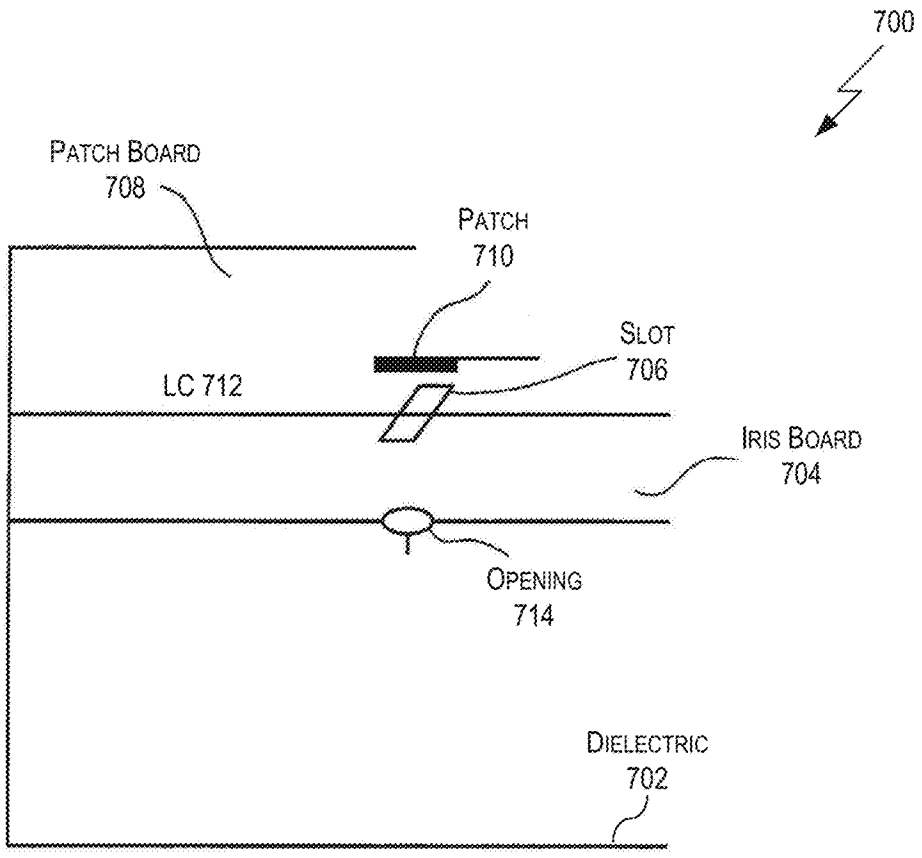
FIG. 7 is a side-view of system diagram of an example of another implementation of the patch antenna that is part of the cylindrically fed antenna structures shown in FIGS. 3 and 5 in accordance with the present disclosure.

In FIG. 7, a side-view of system diagram is shown of an example of another implementation of the patch antenna 700 that is part of the cylindrically fed antenna structures 300 and 500 in accordance with the present disclosure. Referring to FIG. 7, the patch antenna 700 is above dielectric 702 (e.g., a plastic insert, etc.) that is above the interstitial conductor 306 of FIG. 3 (or a ground conductor such as in the case of the antenna in FIG. 5).

An iris board 704 is a ground plane (i.e., a conductor) with a number of slots, such as slot 706 on top of and over dielectric 702. A slot may be referred to herein as an "iris" as both words are interchangeable. In this example, the slots in the iris board 704 may be created by etching. Furthermore, each slot 706 in the iris board 704 may have an optional circular or elliptical opening 714 below the slot 706 that may be about 0.001 inches or 25 millimeters in depth.

A patch board 708 containing a plurality of patches, such as patch 710, is located over the iris board 704, separated by an intermediate dielectric layer. Each of the patches, such as patch 710, are co-located with one of the slots 706 in iris board 704. In this example, the intermediate dielectric layer between the iris board 704 and patch board 708 is a LC substrate layer 712. The LC acts as a dielectric layer between each patch 710 and its co-located slot 706. Alternatively, other substrate layers other than LC may also be used.

As an example, patch board 708 may be include a printed circuit board ("PCB"), and each patch may include metal on the PCB, where the metal around the patch has been removed. Furthermore, the patch board 708 may include vias for each patch that is on the side of the patch board opposite the side where the patch faces its co-located slot. The vias are used to connect one or more traces to a patch to provide voltage to the patch. In this example, a matrix drive may be used to apply voltage to the patches to control them. The voltage is used to tune or detune individual elements to effectuate beam forming. Alternatively, in another example, the patches may be deposited on the glass layer (e.g., a glass typically used for LC displays ("LCDs") such as, for example, Corning Eagle glass), instead of using a PCB.

Figure 8:
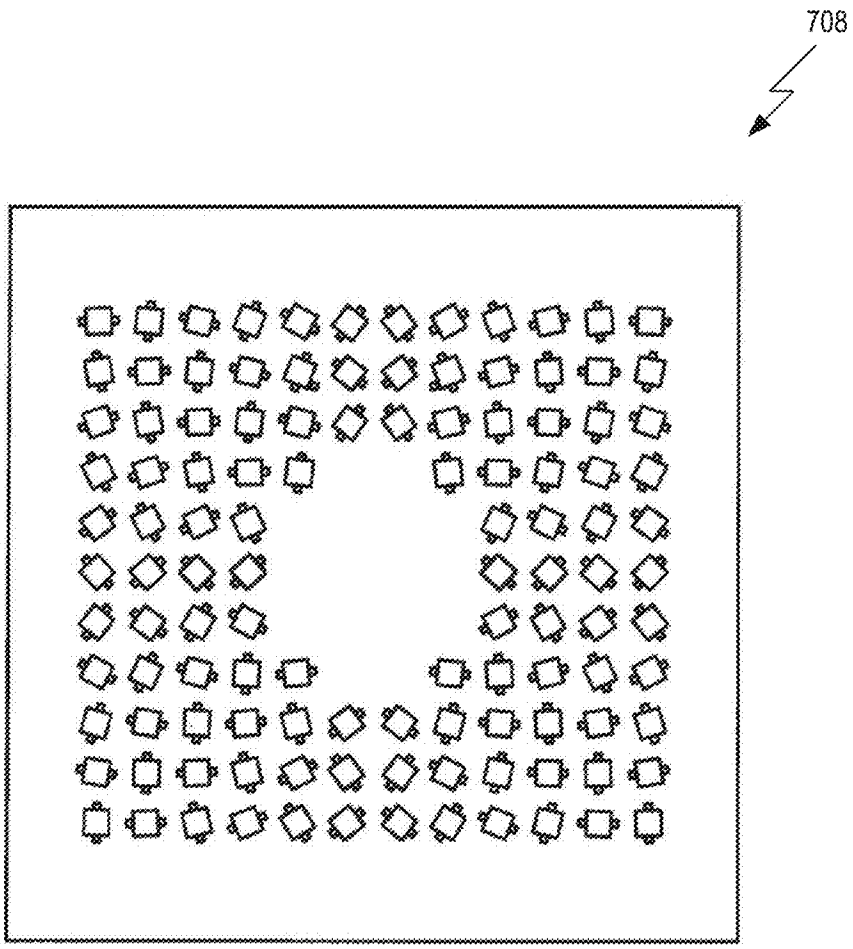
FIG. 8 is a top-view of a system diagram of an example of an implementation of the patch board shown in FIG. 7 in accordance with the present disclosure.

Turning to FIG. 8, a top-view of a system diagram is shown of an example of an implementation of the patch board 708 shown in FIG. 7 in accordance with the present disclosure. In this example, the top-view is of the upper conductor of the CELCs described earlier. Furthermore, in this example, the patch board 708 includes rectangular patches covering slots and completing linearly polarized patch/slot resonant pairs that may be turned off and on. The pairs are turned off or on by applying a voltage to the corresponding patch using a controller (not shown). Generally, the voltage needed is dependent on the LC mixture being used, the resulting threshold voltage needed to begin to tune the LC, and the maximum saturation voltage (beyond which no higher voltage produces any effect except to eventually degrade or short circuit through the LC). In this example, a matrix drive may be used to apply voltage to the patches in order to control the coupling.

In these examples the cylindrically fed antenna has a control system that may include a controller and a matrix drive switching array. The controller may include drive electronics for the antenna system that is below the scattering structure (i.e., the RF array 318 and 514) and the matrix drive switching array may be interspaced throughout the radiating RF array 318 and 514 in such a way as to not interfere with the radiation. As an example, the drive electronics may include known LCD controls utilized in commercial television appliances that adjust the bias voltage for each scattering element by adjusting the amplitude of an AC bias signal to that element. The controller may include a processor that executes software and other electronics such as sensors that provide location and orientation information to the processor.

In general, the controller controls which elements are turned off and those elements turned on at the frequency of operation. The elements are selectively detuned for frequency operation by voltage application. The controller supplies an array of voltage signals to the RF radiating patches to create a modulation, or control pattern. The control pattern causes the elements to be turned on or off. Moreover, the controller is configured to have some elements radiate more strongly than others, rather than some elements radiate and some do not. The variable radiation is achieved by applying specific voltage levels, which adjusts the LC permittivity to varying amounts, thereby detuning elements variably and causing some elements to radiate more than others.

As such, in these examples, the generation of a focused beam by the metamaterial array of elements of the cylindrically fed antenna structures 300 and 500 can be explained by the phenomenon of constructive and destructive interference where individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be ideally pointed in any direction plus or minus 90 degrees from the boresight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the wave front. In general, the time required to turn the unit cells on and off dictates the speed at which the beam can be switched from one location to another location.

As such, based on these descriptions, in general the WLEAS 100 may include a 2D-NGSA 116 that is a cylindrically fed antenna structure 300 or 500 that includes a plurality of slots (including for example slot 604 and/or 706) and a plurality of patches (including for example patch 602 and/or 710). In this example, each of the patches 602 or 710 (of the plurality of patches) is co-located over and separated from a slot 604 or 706, of the plurality of slots, forming the patch-slot pair 610, where each patch-slot pair 610 is capable of being turned off or on based on the application of a voltage to the patch 602 or 710 in the patch-slot pair 610.

Moreover, the WLEAS 100 may also be described as including the dielectric layer 310 or 506, the ground plane 304 or 502, the RF array 318 or 514, the coaxial pin 302 or 512, at least one RF absorber 326, 508, and 510, the interstitial conductor 306, the spacer 308, and a side area. As described earlier, the dielectric layer 310 or 506 is the material layer through which the cylindrical feed traveling wave 312, 314 or 516, 518 travels in directions 316 or 520. The coaxial pin 302 or 512 is an antenna feed that is in signal communication with the ground plane 304 or 502 and is configured to input the cylindrical feed traveling wave 312, 314 or 516, 518 into the dielectric layer 310 or 506. The dielectric layer 310 or 506 is between the ground plane 304 or 502 and the RF array 318 or 514. The at least one RF absorber 326 or 508 and 510 are in signal communication with the ground plane 304 or 502 and 504 and the RF array 318 or 514 to terminate any unused energy so as to prevent reflections of the unused energy back though the dielectric layer 310 or 506. As discussed previously, the dielectric layer 310 or 506 is between the interstitial conductor 306 and the RF array 318 or 514 and the spacer 308 is between the interstitial conductor 306 and the ground plane 304. Moreover, the side areas 323 and 325 are in signal communication with the ground plane 304 and the RF array 318 and 514 where the first side area 323 includes the side 320 and the second side area 325 includes the side 322.

Figure 9:
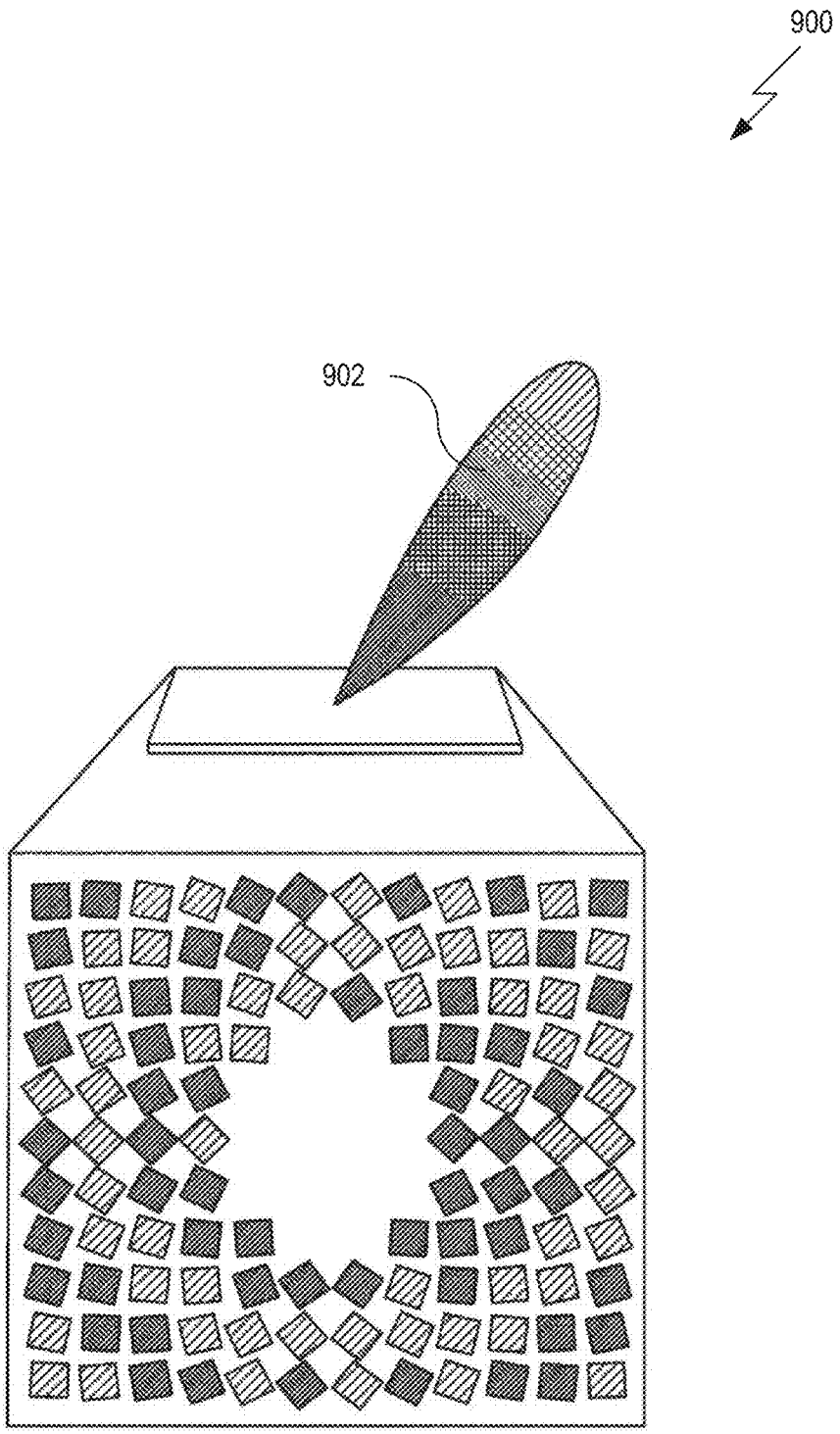
FIG. 9 is a system diagram of an example of an implementation of the cylindrically fed antenna structures forming a two-dimensional scannable antenna beam in accordance with the present disclosure.

Turning to FIG. 9, a system diagram is shown of an example of an implementation of the cylindrically fed antenna structures 900 forming a two-dimensional scannable antenna beam 902. In this example, the interference pattern may be adjusted to provide arbitrary antenna radiation patterns (i.e., an antenna beam 902) by identifying an interference pattern corresponding to a selected beam pattern and then adjusting the voltage across the scattering elements to produce a beam according the principles of holography. The basic principle of holography, including the terms "object beam" and "reference beam," as commonly used in connection with these principles, is well-known to those of ordinary skill in the art. In these examples, the 2D-NGSA 116 may utilizes a power level of approximately 20 Watts or less.

Figure 10:
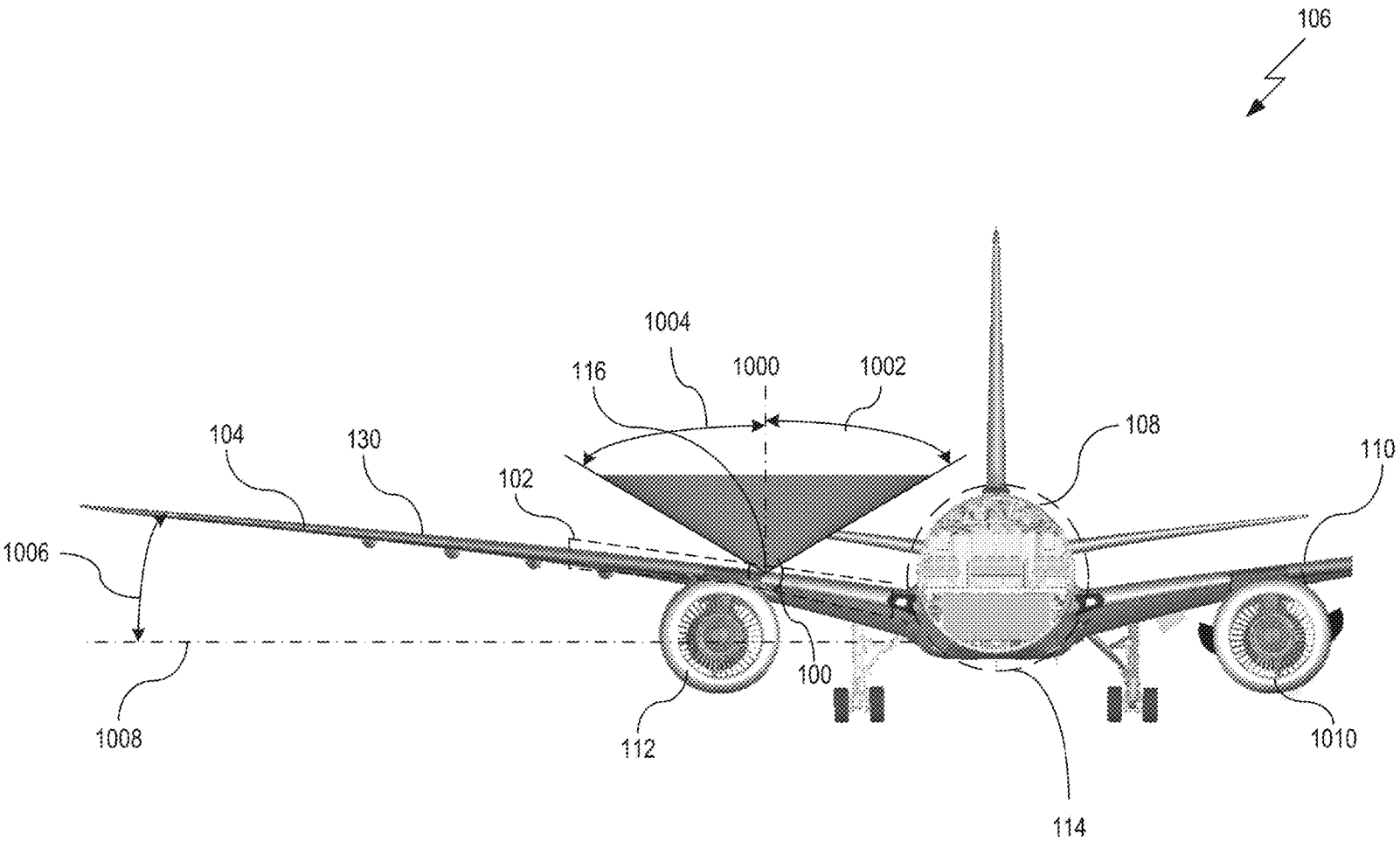
FIG. 10 is a front-view of the system diagram shown in FIG. 1 in accordance with the present disclosure.

In FIG. 10, a front-view of the system diagram shown in FIG. 1 is shown in accordance with the present disclosure. In this example, the 2D-NGSA 116 is shown to have a boresight 1000 that extends vertically from the first wing 104 and a positive scan angle 1002 of approximately positive 60 degrees and a negative scan angle 1004 of approximately negative 60 degrees. As a result, the 2D-NGSA 116 has a 60 degree scan cone from the vertical boresight 1000 that is electronically steered and does not interfere with the body of the fuselage 108 of the aircraft 106. It is appreciated by those of ordinary skill that the scan cone may be varied based on the size of the aircraft 106, the angle 1006 of the wing 104 relative to a horizontal reference plane 1008, and the distance of the first engine 112 from the fuselage 108 along the wing 104. Moreover, is appreciated that a second WLEAS may be placed within the second wing 110 in proximity to a second engine 1010 of the aircraft 106.

Figure 11:
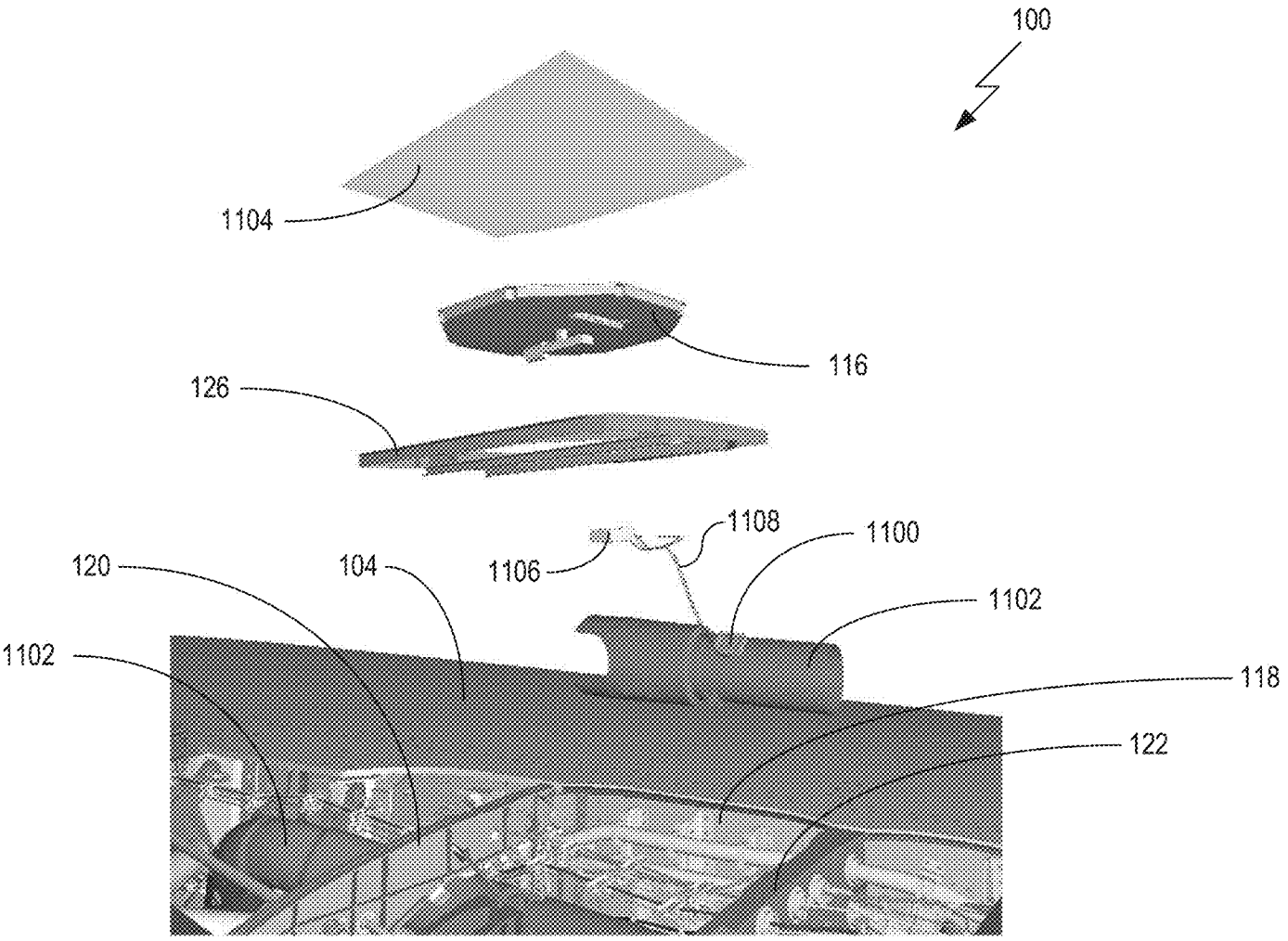
FIG. 11 is an exploded assembly view of an example of an implementation of the WLEAS, shown in FIGS. 1 and 2, utilizing a thermo-electric generator ("TEG") in a first configuration in accordance with the present disclosure.

Turning to FIG. 11, an exploded assembly view is shown of an example of an implementation of the WLEAS 100 utilizing a thermo-electric generator ("TEG") 1100 (also known as a "Seebeck generator") in a first configuration in accordance with the present disclosure. In this example, the TEG 1100 may be utilized to power the 2D-NGSA 116. Specifically, the TEG 1100 is a solid-state device that creates direct-current ("DC") power via temperature differential across the TEG 1100. As such, the TEG 1100, in this example of a configuration, is placed in physical contact (i.e., the TEG 1100 is physically touching) a bleed air duct 1102 of the aircraft 106 that bleeds hot air from the first engine 112. In this example, the WLEAS 100 includes 2D-NGSA 116, adapter plate 126, radome 1104, TEG 1100, and a TEG controller 1106. In this example, the radome 1104 may be a tri-band radome that also acts as a LE panel on the upper LE 102 of the wing 104 to cover the WLEAS 100.

The TEG 1100 is shown as having a hot-side that is physically attached to the surface of the bleed air duct 1102 to absorb some of the heat produced by the surface of the bleed air duct 1102. The other side of the TEG 1100 is a cool-side of the TEG 1100 and includes or is in physical contact with a heat-sink that cools off the TEG 1100. The temperature differential between the hot-side and cool-side of the TEG 1100 produces a DC current that is passed to the TEG controller 1106 via one or more power leads 1108. The TEG controller 1106 receives the DC current from the TEG 1100 and then powers the 2D-NGSA 116.

Figure 12:
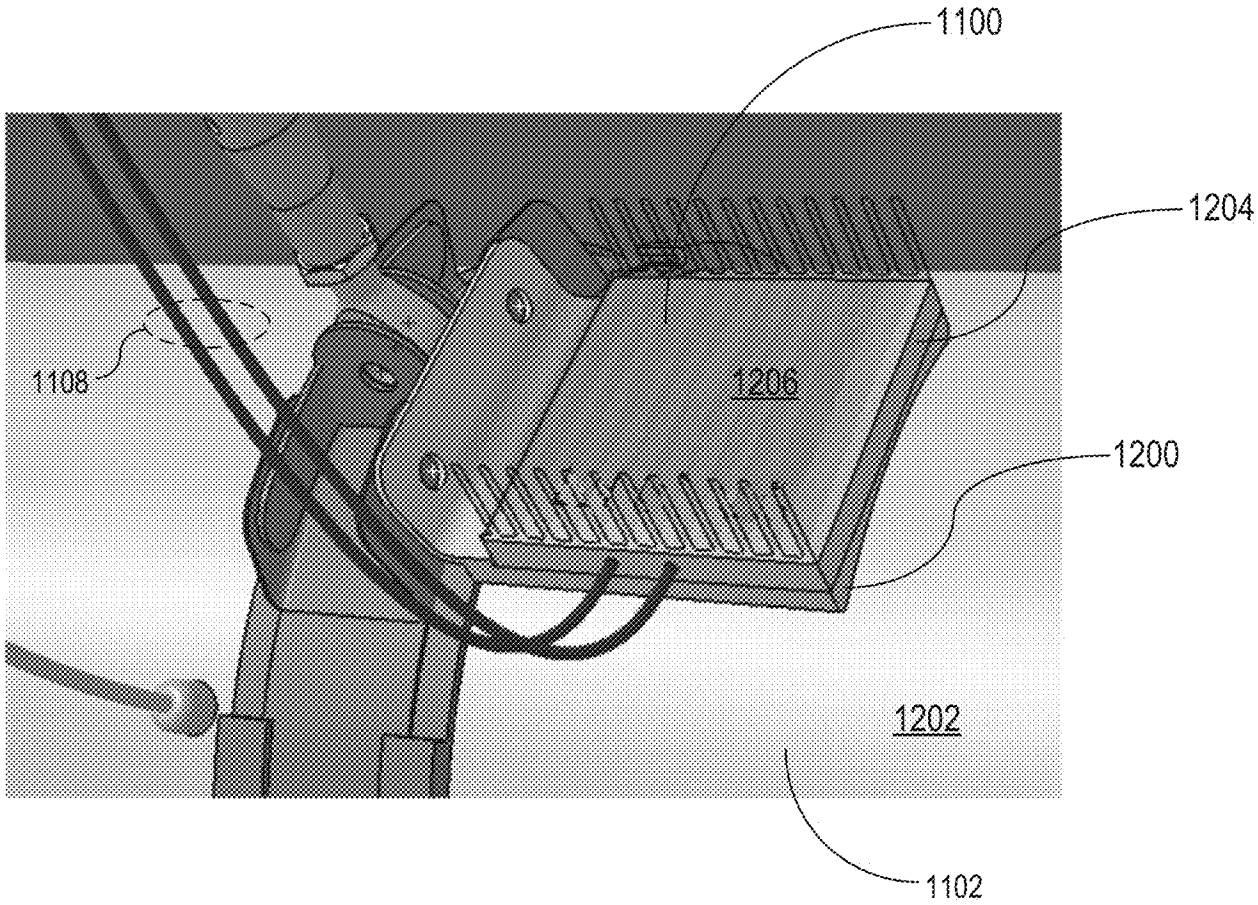
FIG. 12 is a system diagram of an example of an implementation of the TEG shown in FIG. 11 in accordance with the present disclosure.

More specifically, in FIG. 12, a system diagram of an example of an implementation of the TEG 1100 is shown in accordance with the present disclosure. In this example, the TEG 1100 is shown to have a hot-side 1200 in physical contact with the surface 1202 of the bleed air duct 1102 and a cool-side 1204 in physical contact with the heat-sink 1206. Alternatively, the TEG 1100 instead of being in physical contact with the surface 1202 of the bleed air duct 1102, may receive bleed air from the bleed air duct 1102 to produce the DC current.

Figure 13:
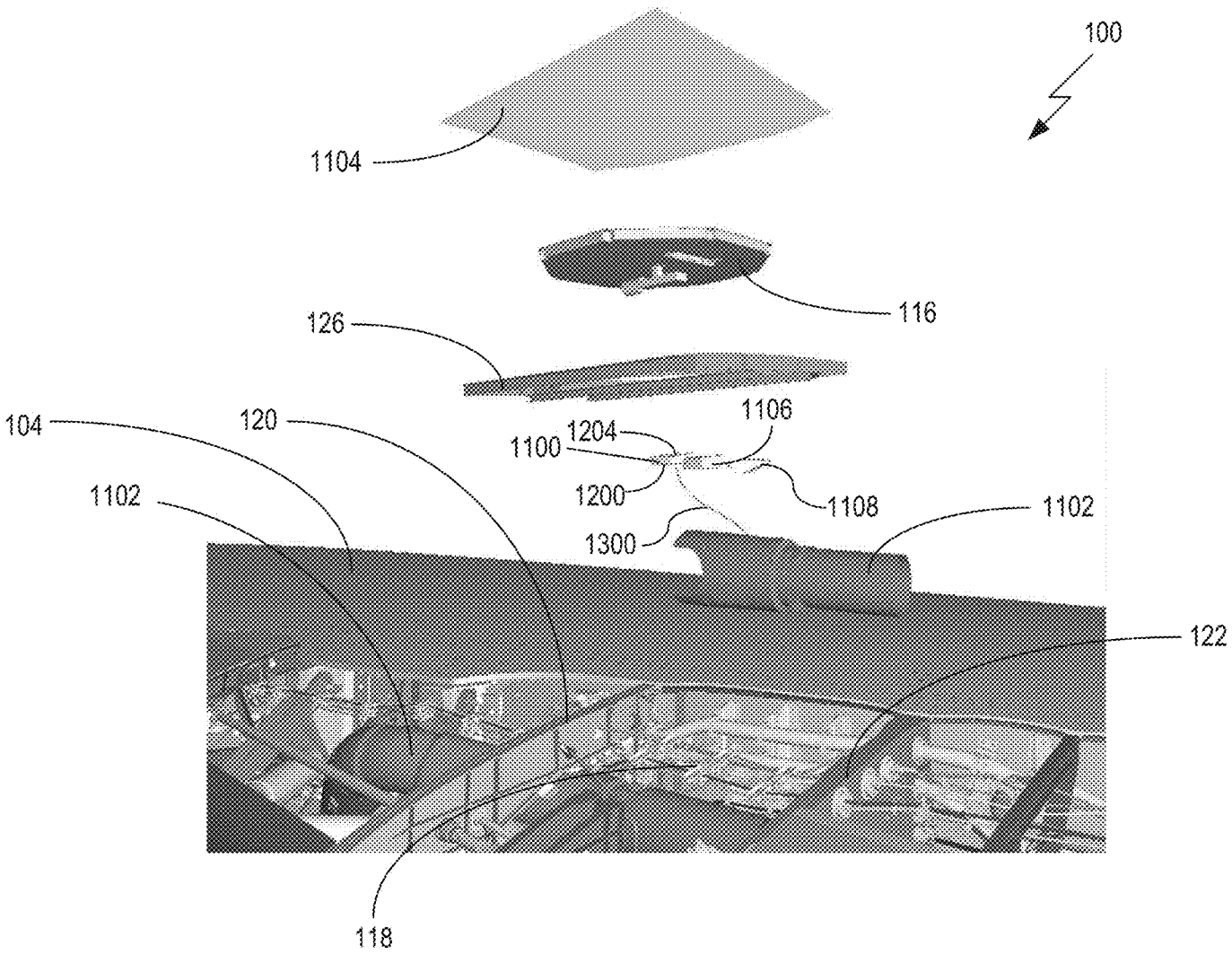
FIG. 13 is an exploded assembly view of an example of an implementation of the WLEAS, shown in FIGS. 1 and 2, utilizing a TEG in a second configuration in accordance with the present disclosure.
Figure 14:
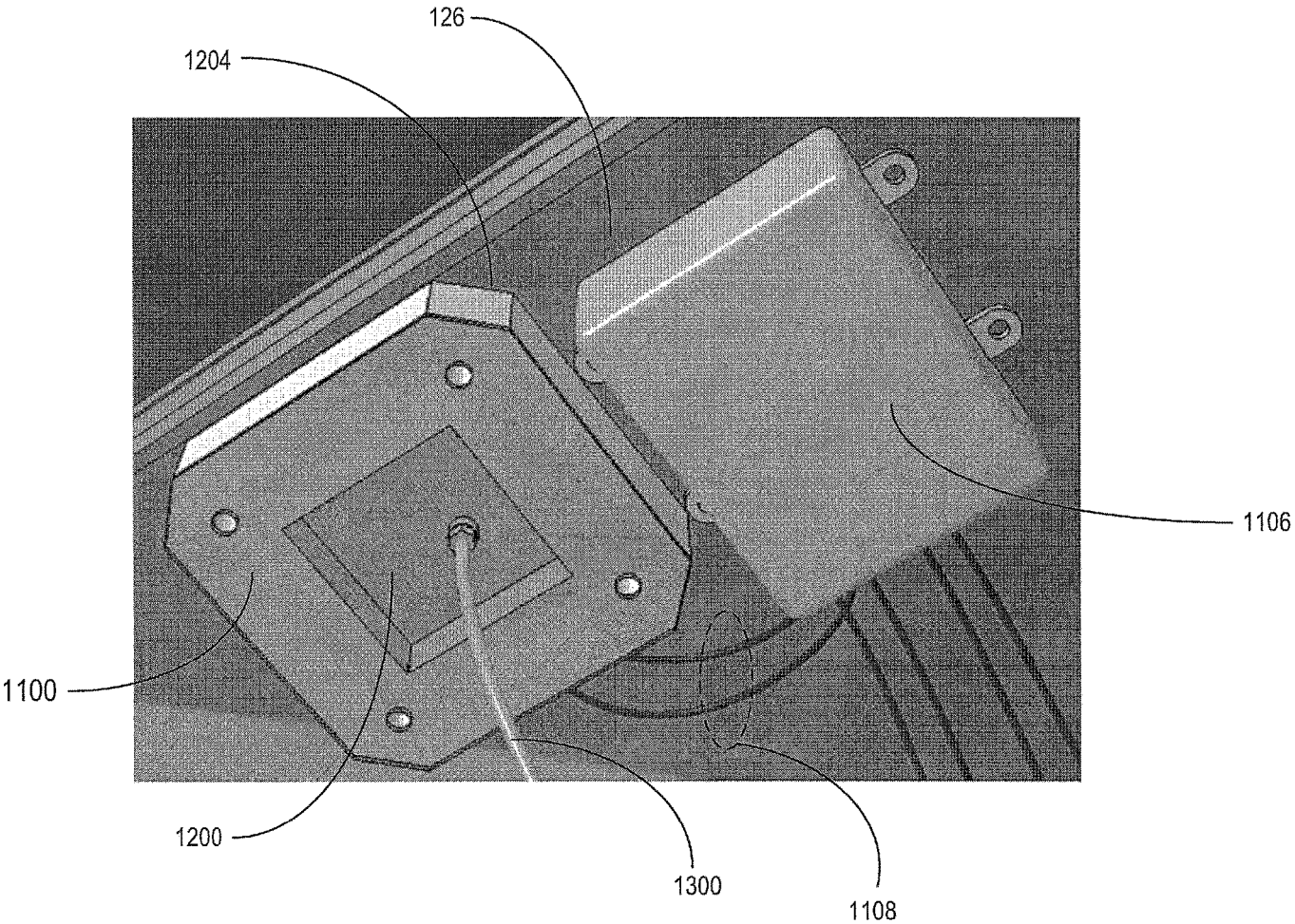
FIG. 14 is a system diagram of an example of an implementation of the TEG shown in FIG. 12 in accordance with the present disclosure.

In FIG. 13, an exploded assembly view of an example of an implementation of the WLEAS 100 utilizing a TEG 1100 in a second configuration is shown in accordance with the present disclosure. Specifically, in this alternative configuration, the TEG 1100 receives a portion of the bleed air from the bleed air duct 1102 via a bleed tube 1300. The bleed tube 1300 is in physical contact with the hot-side 1200 of the TEG 1100, while the cool-side 1204 is in physical contact with the adapter plate 126 maintaining the cool-side 1204 at a lower temperature than the hot-side 1200. In FIG. 14, a system diagram of an example of an implementation of the TEG 1100 is shown for the example of the second configuration in accordance with the present disclosure.

Figure 15:
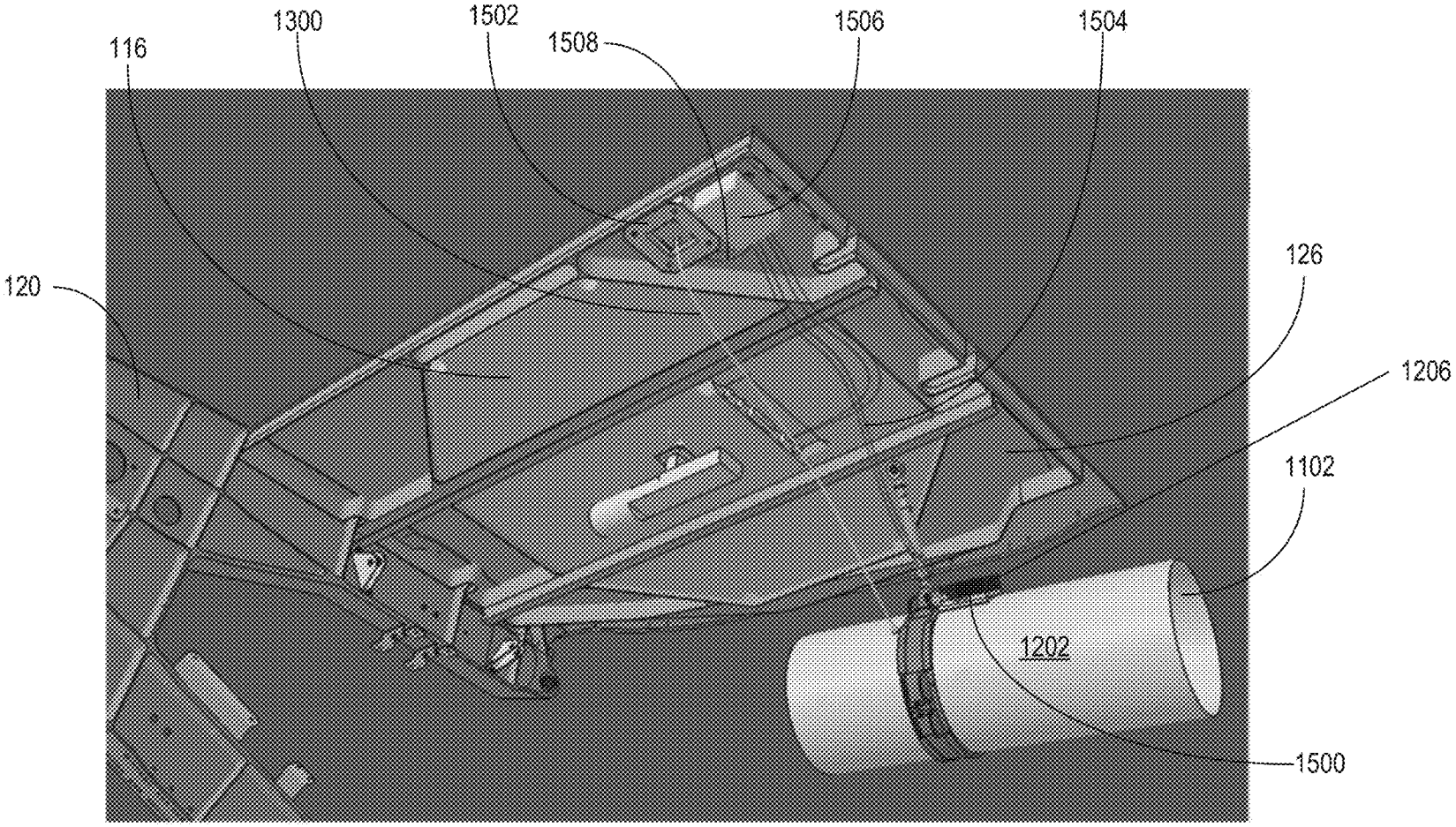
FIG. 15 is a system diagram of an example of an implementation of the two configurations of the TEG for the WLEAS shown in both FIGS. 12 and 13 in accordance with the present disclosure.

Turning to FIG. 15, a system diagram of an example of an implementation of the two configurations of the TEG for the WLEAS 100 is shown in accordance with the present disclosure. In this example two TEGs are utilized. The first TEG 1500 is placed on the surface 1202 of the bleed air duct 1102 and the second TEG 1502 is placed on the surface of the adapter plate 126.

In an example of operation, the first TEG 1500 operates as described earlier for the first configuration generating a first DC current based on the difference in temperature from the surface 1202 of the bleed air duct 1102 and the heat-sink 1206. The first DC current is then passed, via first set of power leads 1504, to a common TEG controller 1506 in signal communication with both the first TEG 1500 and second TEG 1502.

The second TEG 1502 operates as described earlier for the second configuration generating a second DC current based on the difference in temperature from the hot bleed air provided by the bleed tube to the hot-side 1200 of the second TEG 1502 and the surface of the adapter plate 126 in physical contact with the cool-side 1204 of the second TEG 1502. The second DC current is then passed, via the second set of power leads 1508, to the common TEG controller 1506. The common TEG controller 1506 then combines the first and second DC currents and powers the 2D-NGSA 116. As an example of an implementation, the TEGs 1500, 1502 may be implemented utilizing a TEG1-PB-12611-6.0 TEG module produced by TECTEG MFR. of Aurora, Ontario, Canada or other similar devices.

It is appreciated by those of ordinary skill in the art that other forms of power for powering the WLEAS 100 may also be utilized including utilizing power form the power systems and electronic buses within the aircraft 106. In general, the use of TEG modules to power the WLEAS 100 is a way of utilizing available energy from the engines of the aircraft 106 without having to load or pull power for the existing electrical systems of the aircraft 106. The may be usefully especially in the case of upgrading or retrofitting existing aircraft 106. Moreover, it is appreciated by those of ordinary skill in the art that the use of the TEG modules are not just limited to jet propulsion aircraft and may also be utilized with propeller and turbo-prop propulsion sets.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A wing leading edge antenna system ("WLEAS"), the WLEAS comprising:

an upper leading edge ("LE") of a wing of an aircraft having two LE ribs within a LE cavity and the LE cavity formed by the two LE ribs and a lower LE of the wing;

a two-dimensional non-gimbaled scannable antenna ("2D-NGSA"); and an adapter plate attached to both of the LE ribs, wherein the 2D-NGSA is attached to the adapter plate within the LE cavity.

2. The WLEAS of claim 1, further including a radome surface located on the upper LE of the wing covering the 2D-NGSA.

3. The WLEAS of claim 1, wherein the 2D-NGSA is a phased array antenna.

4. The WLEAS of claim 3, wherein the 2D-NGSA has a diameter that is approximately 30 inches and a thickness that is approximately 2 inches.

5. The WLEAS of claim 1, wherein the 2D-NGSA is a cylindrically fed antenna structure, wherein the cylindrically fed antenna structure includes an antenna feed to input a cylindrical feed traveling wave, a radio frequency ("RF") array having a tunable slotted array in signal communication with the antenna feed, wherein the tunable slotted array includes a plurality of slots, and wherein each slot of the plurality of slots is tuned to provide a desired scattering radiation at a given frequency.

6. The WLEAS of claim 1, wherein the 2D-NGSA is a cylindrically fed antenna structure that includes a plurality of slots, and a plurality of patches, wherein each of the patches of the plurality of patches is co-located over and separated from a slot of the plurality of slots forming a patch-slot pair, and wherein each patch-slot pair is turned off or on based on an application of a voltage to a patch in the patch-slot pair.

7. The WLEAS of claim 1, further including a dielectric layer through which a cylindrical feed traveling wave travels, a ground plane, a radio frequency ("RF") array, a coaxial pin in signal communication with the ground plane to input the cylindrical feed traveling wave into the dielectric layer, wherein the dielectric layer is between the ground plane and the RF array, at least one RF absorber in signal communication with the ground plane and the RF array to terminate unused energy to prevent reflections of the unused energy back through the dielectric layer, an interstitial conductor, wherein the dielectric layer is between the interstitial conductor and the RF array, a spacer between the interstitial conductor and the ground plane, and a side area that is in signal communication with the ground plane and the RF array.

8. The WLEAS of claim 1, wherein the 2D-NGSA utilizes a power level of approximately 20 Watts or less.

9. The WLEAS of claim 1, further including a thermo-electric generator ("TEG") in signal communication with the 2D-NGSA, wherein the TEG includes a hot-side and a cool-side, and wherein the upper LE of the wing is located near an engine of the aircraft.

10. The WLEAS of claim 9, further including a TEG controller in signal communication with the TEG and the 2D-NGSA, wherein the hot-side of the TEG is in physical contact with a bleed air duct of the engine and the cool-side of the TEG is in physical contact with a heat-sink.

11. The WLEAS of claim 9, further including a TEG controller in signal communication with the TEG and the 2D-NGSA, wherein the hot-side of the TEG is in physical contact with bleed air from a bleed air duct of the engine and the cool-side of the TEG is in physical contact with the adapter plate.

12. A scannable antenna system for use in an upper leading edge ("LE") of a wing of an aircraft having two LE ribs and a LE cavity formed by the two LE ribs and a lower LE of the wing, the scannable antenna system comprising:

a two-dimensional non-gimbaled scannable antenna ("2D-NGSA"); and an adapter plate attached to both of the LE ribs within the LE cavity, wherein the 2D-NGSA is attached to the adapter plate within the LE cavity.

13. The scannable antenna system of claim 12, further including a radome surface located on the upper LE of the wing covering the 2D-NGSA.

14. The scannable antenna system of claim 13, wherein the 2D-NGSA is a phased array antenna.

15. The scannable antenna system of claim 14, wherein the 2D-NGSA has a diameter that is approximately 30 inches and a thickness that is approximately 2 inches.

16. The scannable antenna system of claim 12, wherein the 2D-NGSA is a cylindrically fed antenna structure, wherein the cylindrically fed antenna structure includes an antenna feed to input a cylindrical feed traveling wave, a radio frequency ("RF") array having a tunable slotted array in signal communication with the antenna feed, wherein the tunable slotted array includes a plurality of slots, and wherein each slot of the plurality of slots is tuned to provide a desired scattering radiation at a given frequency.

17. The scannable antenna system of claim 12, wherein the 2D-NGSA is a cylindrically fed antenna structure that includes a plurality of slots, and a plurality of patches, wherein each of the patches of the plurality of patches is co-located over and separated from a slot of the plurality of slots forming a patch-slot pair, and wherein each patch-slot pair is turned off or on based on an application of a voltage to a patch in the patch-slot pair.

18. The scannable antenna system of claim 12 further including a dielectric layer through which a cylindrical feed traveling wave travels, a ground plane, a radio frequency ("RF") array, a coaxial pin in signal communication with the ground plane to input the cylindrical feed traveling wave into the dielectric layer, wherein the dielectric layer is between the ground plane and the RF array, at least one RF absorber in signal communication with the ground plane and the RF array to terminate unused energy to prevent reflections of the unused energy back through the dielectric layer, an interstitial conductor, wherein the dielectric layer is between the interstitial conductor and the RF array, a spacer between the interstitial conductor and the ground plane, and a side area that is in signal communication with the ground plane and the RF array.

19. The scannable antenna system of claim 12, wherein the 2D-NGSA utilizes a power level of approximately 20 Watts or less.

20. The scannable antenna system of claim 12, further including a thermo-electric generator ("TEG") in signal communication with the 2D-NGSA, wherein the TEG includes a hot-side and a cool-side, and wherein the upper LE of the wing is located near an engine of the aircraft.

* * * * *